US009539454B1

(12) United States Patent
Griggs et al.

(10) Patent No.: US 9,539,454 B1
(45) Date of Patent: Jan. 10, 2017

(54) APPLIANCE SPECIFIC LASER AIMING DEVICE

(71) Applicants: Anthony Griggs, Indianapolis, IN (US); Stephanie Redmon, Indianapolis, IN (US)

(72) Inventors: Anthony Griggs, Indianapolis, IN (US); Stephanie Redmon, Indianapolis, IN (US)

( * ) Notice: Subject to any disclaimer, the term of this patent is extended or adjusted under 35 U.S.C. 154(b) by 0 days.

(21) Appl. No.: 14/802,739

(22) Filed: Jul. 17, 2015

(51) Int. Cl.
*A62C 37/00* (2006.01)
*A62C 37/50* (2006.01)
*B05B 12/00* (2006.01)

(52) U.S. Cl.
CPC ..... *A62C 37/50* (2013.01); *B05B 12/004* (2013.01)

(58) Field of Classification Search
CPC ..... A62C 37/50; B05B 12/004
USPC ... 239/1, 71, 73, 289; 118/300, 713; 356/3.1
See application file for complete search history.

(56) References Cited

U.S. PATENT DOCUMENTS

| | | | | |
|---|---|---|---|---|
| D253,245 | S | 10/1979 | Allenbaugh, Jr. | |
| 5,312,039 | A | 5/1994 | Sayka et al. | |
| 5,598,972 | A * | 2/1997 | Klein, II | B05B 12/004 239/1 |
| 5,868,840 | A * | 2/1999 | Klein, II | B05B 15/06 118/300 |
| 7,188,781 | B2 | 3/2007 | Reighard et al. | |
| 2003/0178503 | A1 * | 9/2003 | Horan | B05B 12/004 239/73 |

* cited by examiner

*Primary Examiner* — Michael Maskell
(74) *Attorney, Agent, or Firm* — Stevenson IP, LLC

(57) ABSTRACT

An appliance specific laser aiming device for visual spray pattern testing of fire suppression spray nozzles has a hollow cylindrical body with a first end threadably fitted to an adapter that is fitted to the existing spray nozzle. A laser module within the cylindrical body projects a light beam through the interior and out of the lens on the second end. The second end has dial adjustment. A hollow housing with grip removably and rotatably fits to proximal the first end. Rotating the hollow housing positions a chosen nozzle depiction for setting to match specific spray nozzle characteristics wherein one device tests a plurality of nozzles, including those of various manufacturers.

4 Claims, 2 Drawing Sheets

APPLIANCE SPECIFIC LASER AIMING DEVICE

BACKGROUND OF THE INVENTION

A need to measure exact spray patterns and directions of fire suppression systems used to halt fire or extreme heat is well established. For example, specific sprays are used in restaurant kitchens with such sprays designed to properly cover various appliances, as they are in other industries. One example of such includes 11 exacting nozzle types including: 1. ½N=flow in a fan pattern; 2. 1F=flow in a wide pattern; 3. 1W=flow in a wide pattern; 4. 1N=flow in a narrow pattern; 5. 2W=2 flows in a wide pattern; 6. 230=2 flows in a 30 degree pattern; 7. 245=2 flows in a 45 degree pattern; 8. 260=2 flows in a 60 degree pattern; 9. 290=2 flows in a 90 degree pattern; 10. 2120=2 flows in a 120 degree pattern; and 11. 3N=3 flows in a narrow pattern.

These nozzles are visually quite similar and have various common parts. However, each nozzle tip is designed for quite specific application. It is noted that sprays in use in industries such as the restaurant field require extremely exact placement in order to ensure pattern and directional spray issuance over the various appliances and areas within such environments. Spray testing devices to date have proven inadequate in that the need for a multi-adjustable device to match a plurality of spray nozzles exemplified above to determine both direction and correct spray pattern has not been fulfilled. Single devices for each nozzle have proven impractical and expensive. A device for use with multiple nozzles, with adjustable appliance specificity is needed, wherein one device can be fitted to a variety of nozzles, via adapter, to visually determine direction and spray pattern applicable to each appliance nozzle, nozzles as exemplified by those above.

The present appliance specific laser aiming device removably attaches to an existing fire suppressant nozzle adapter and fulfills this need.

FIELD OF THE INVENTION

The present appliance specific laser aiming device relates to tools to test fire suppression system spray patterns and direction.

SUMMARY OF THE INVENTION

The general purpose of the appliance specific laser aiming device, described subsequently in greater detail, is to provide an appliance specific laser aiming device that has many novel features that result in an appliance specific laser aiming device which is not anticipated, rendered obvious, suggested, or even implied by prior art, either alone or in combination thereof.

To accomplish this, the appliance specific laser aiming device has a cylindrical member having a first end spaced apart from a second end. A threaded section is disposed at the first end. A shoulder is attached to the threaded section distal the first end. A bevel is disposed atop the shoulder. A hollow sleeve is disposed atop the bevel. An energy compartment is disposed within the sleeve. An energy source is removably disposed within the energy compartment. An exteriorly accessible on/off button is disposed within the sleeve. The on/off button is in operational communication with the energy compartment. A laser module disposed within the sleeve is in operational communication with the on/off button and the energy compartment. A laser light is configured to issue centrally upward from the sleeve with an on position of the on/off switch. A reference indicator is disposed on an exterior of the sleeve.

A grip ring is removably and rotatably disposed at least partially atop the sleeve. A dial housing is affixed to the grip ring and extended to the second end. A plurality of nozzle depictions is disposed within a perimeter of the second end. The nozzle depictions are beveled and are also selectively flat. One dial notch of a plurality of dial notches is disposed below each nozzle depiction. A disc is disposed within the plurality of nozzle depictions. A lens is disposed centrally within the disc.

A gear drive system is disposed within the dial housing. The gear drive system has a drive gear disposed within an inner perimeter of the dial housing. At least one vertically disposed axle is affixed to the sleeve. Each axle is offset from a centerline of the cylindrical member. A slave gear is disposed horizontally on the axle. The device, depending upon application, is also provided with more than one axle, also having a slave gear. One slave gear of one axle is in operational communication with the drive gear. With each of the two axles having a slave gear, the slave gears are interactive. A filter wheel is disposed on one slave gear. The filter wheel has a plurality of sequentially disposed light filters. Each light filter of the plurality of light filters matches one nozzle depiction of the plurality of nozzle depictions.

A rotation of the dial housing is configured to align one dial notch of the plurality of dial notches with the reference indicator. One dial notch of the plurality of dial notches is configured to position one light filter of the plurality of light filters centrally within the dial housing. The laser light is configured to pass through the light filter and issue through the lens.

In use, an existing adapter is fastened to the fire suppression nozzle to be tested. The fastened adapter fit is predetermined. The device is threaded into the adapter for specific rotational positioning. The laser light emitted from the device provides a clear visual to a technician in reference to nozzle function, as both pattern and pattern positioning are critical. The technician determines if the pattern and the pattern positioning are correct or if the nozzle needs adjustment or replacement.

Thus has been broadly outlined the more important features of the present appliance specific laser aiming device so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 3:
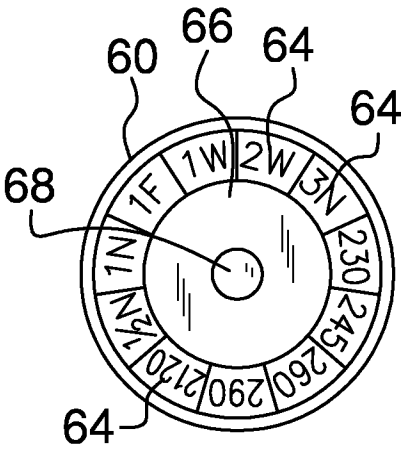
FIG. 3 is a top plan view.
Figure 2:
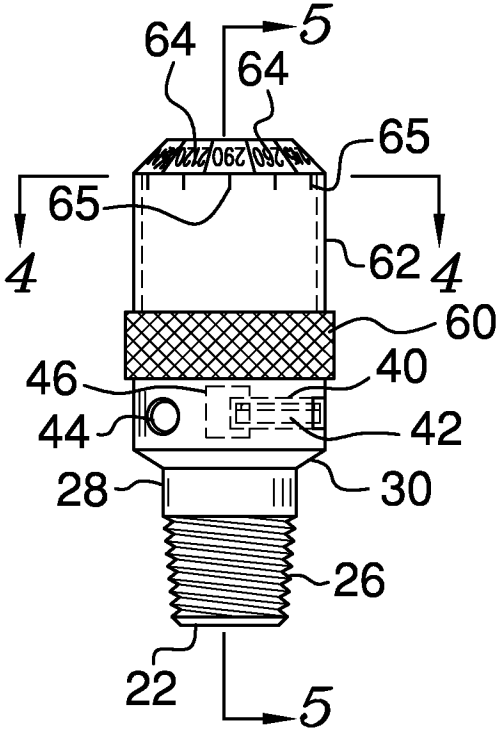
FIG. 2 is a lateral elevation view.
Figure 1:
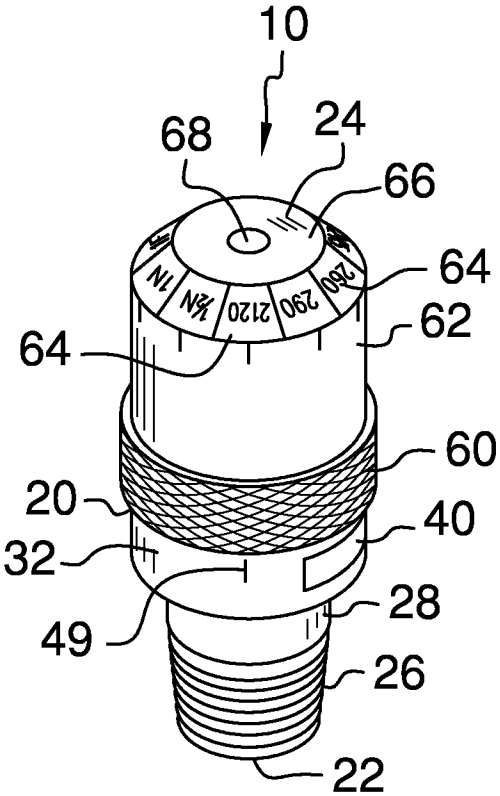
FIG. 1 is a perspective view.
Figure 5:
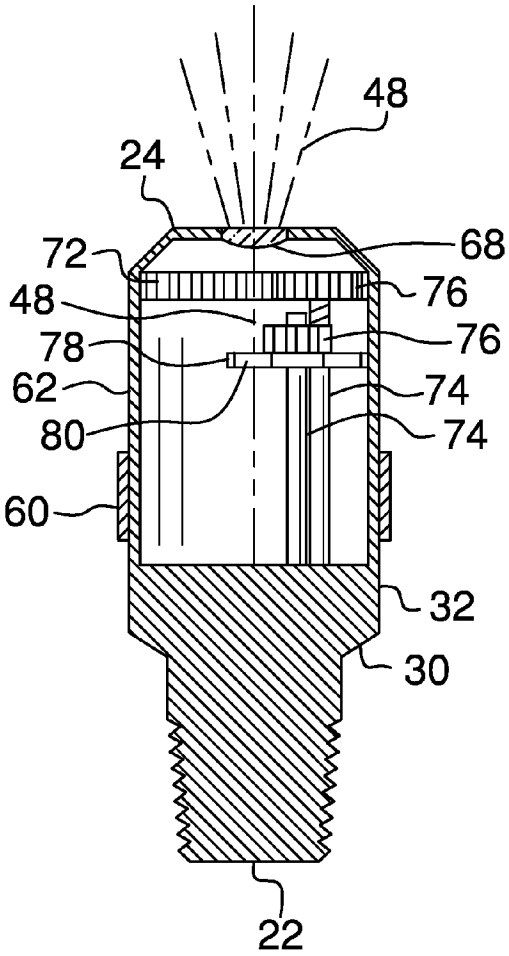
FIG. 5 is a cross sectional view of FIG. 2 taken along line 5-5.
Figure 4:
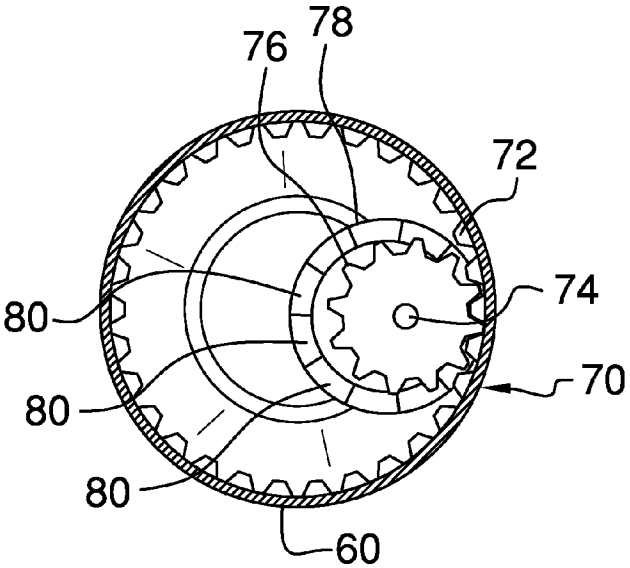
FIG. 4 is a cross sectional view of FIG. 2 taken along line 4-4.

With reference now to the drawings, and in particular FIGS. 1 through 5 thereof, an example of the appliance specific laser aiming device employing the principles and concepts of the present appliance specific laser aiming device and generally designated by the reference number 10 will be described.

Referring to FIGS. 1 through 5, the appliance specific laser aiming device 10 has a cylindrical member 20 having a first end 22 spaced apart from a second end 24. A threaded section 26 is disposed at the first end 22. A shoulder 28 is attached to the threaded section 26 distal the first end 22. A bevel 30 is disposed atop the shoulder 28. A hollow sleeve 32 is disposed atop the bevel 30. An energy compartment 40 is disposed within the sleeve 32. An energy source 42 is removably disposed within the energy compartment 40. An exteriorly accessible on/off button 44 is disposed within the sleeve 32. The on/off button 44 is in operational communication with the energy compartment 40. A laser module 46 is disposed within the sleeve 32. The laser module 46 is in operational communication with the on/off button 44 and the energy compartment 40. A laser light 48 is configured to issue centrally upward from the sleeve 32 with an on position of the on/off switch. A reference indicator 49 is disposed on an exterior of the sleeve 32.

A grip ring 60 is removably and rotatably disposed at least partially atop the sleeve 32. A dial housing 62 is affixed to the grip ring 60 and is extended to the second end 24. A plurality of nozzle depictions 64 is disposed within a perimeter of the second end 24. The nozzle depictions 64 are beveled and are also selectively flat. Beveling is sometimes a visual benefit to a technician when using the device 10. One dial notch 65 of a plurality of dial notches 65 is disposed below each nozzle depiction 64 of the plurality of nozzle depictions 64. A disc 66 is disposed within the plurality of nozzle depictions 64. A lens 68 is disposed centrally within the disc.

A gear drive system 70 is disposed within the dial housing 62. The gear drive system 70 has a drive gear 72 disposed within an inner perimeter of the dial housing 62. At least one vertically disposed axle 74 is affixed to the sleeve 32. Each axle 74 provided is offset from a centerline of the cylindrical member 20. A slave gear 76 is disposed horizontally on each axle 74. One slave gear 76 is in operational communication with the drive gear 72. With two axles 74, each axle 74 has a slave gear 76 and the slave gears 76 are interactive. A filter wheel 78 is disposed on one slave gear. The filter wheel 78 has a plurality of sequentially disposed light filters 80. Each light filter 80 of the plurality of light filters 80 matches one nozzle depiction 64 of the plurality of nozzle depictions 64. A rotation of the dial housing 62 is configured to align one dial notch 65 of the plurality of dial notches 65 with the reference indicator 49. One dial notch 65 of the plurality of dial notches 65 is configured to position one light filter 80 of the plurality of light filters 80 centrally within the dial housing 62. The light filters 80 are therein chosen by the corresponding nozzle depiction 64. The laser light 48 is configured to pass through the light filter 80 and issue through the lens 68.

In use, an existing adapter is fastened to the fire suppression nozzle to be tested. The fastened adapter fit is predetermined. The device 10 is threaded into the adapter for specific rotational positioning. The laser light 48 emitted from the device 10 provides a clear visual to a technician in reference to nozzle function, as both pattern and pattern positioning are critical. The technician determines if the pattern and the pattern positioning are correct or if the nozzle needs adjustment or replacement.

What is claimed is:

1. An appliance specific laser aiming device comprising:
- a cylindrical member having a first end and a second end spaced apart from the first end;
- a threaded section disposed at the first end;
- a shoulder attached to the threaded section distal the first end;
- a bevel disposed atop the shoulder;
- a hollow sleeve disposed atop the bevel;
- an energy compartment disposed within the sleeve;
- an energy source removably disposed within the energy compartment;
- an exteriorly accessible on/off button disposed within the sleeve, the on/off button in operational communication with the energy compartment;
- a laser module in operational communication with the on/off button and the energy compartment;
- wherein a laser light is configured to issue centrally upward from the sleeve with an on position of the on/off switch;
- a reference indicator disposed on an exterior of the sleeve;
- a grip ring removably and rotatably disposed at least partially atop the sleeve;
- a dial housing affixed to the grip ring and extended to the second end;
- a plurality of nozzle depictions disposed within a perimeter of the second end;
- a plurality of dial notches, one dial notch of the plurality of dial notches disposed below each nozzle depiction of the plurality of nozzle depictions;
- a disc disposed within the plurality of nozzle depictions;
- a lens disposed within the disc;
- a gear drive system disposed within the dial housing, the gear drive system comprising:
  - a drive gear disposed within an inner perimeter of the dial housing;
  - a vertically disposed axle affixed to the sleeve, the axle offset from a centerline of the cylindrical member;
  - a slave gear disposed horizontally and rotatably on the axle, the slave gear in operational communication with the drive gear; and
  - a filter wheel disposed on the slave gear, the filter wheel having a plurality of sequentially disposed light filters, one light filter of the plurality of light filters matching one nozzle depiction of the plurality of nozzle depictions;
- wherein a rotation of the dial housing is configured to align one dial notch of the plurality of dial notches with the reference indicator;
- wherein one dial notch of the plurality of dial notches is configured to position one light filter of the plurality of light filters centrally within the dial housing; and
- wherein the laser light is configured to pass through one light filter of the plurality of light filters and issue through the lens.

2. The appliance specific laser aiming device of claim 1 wherein the plurality of nozzle depictions are beveled.

3. An appliance specific laser aiming device comprising:
- a cylindrical member having a first end spaced apart from a second end;
- a threaded section disposed at the first end;
- a shoulder attached to the threaded section distal the first end;
- a bevel disposed atop the shoulder;
- a hollow sleeve disposed atop the bevel;
- an energy compartment disposed within the sleeve;
- an energy source removably disposed within the energy compartment;
- an exteriorly accessible on/off button disposed within the sleeve, the on/off button in operational communication with the energy compartment;

a laser module in operational communication with the on/off button and the energy compartment;

wherein a laser light is configured to issue centrally upward from the sleeve with an on position of the on/off switch;

a reference indicator disposed on an exterior of the sleeve;

a grip ring removably and rotatably disposed at least partially atop the sleeve;

a dial housing affixed to the grip ring and extended to the second end;

a plurality of nozzle depictions disposed within a perimeter of the second end;

a plurality of dial notches, one dial notch of the plurality of dial notches disposed below each nozzle depiction of the plurality of nozzle depictions;

a disc disposed within the plurality of nozzle depictions;

a lens disposed within the disc;

a gear drive system disposed within the dial housing, the gear drive system comprising:

a drive gear disposed within an inner perimeter of the dial housing;

at least one vertically disposed axle affixed to the sleeve, each axle offset from a centerline of the cylindrical member;

a slave gear disposed horizontally one axle, one slave gear of one axle in operational communication with the drive gear; and a filter wheel disposed on one slave gear, the filter wheel having a plurality of sequentially disposed light filters, each light filter of the plurality of light filters matching one nozzle depiction of the plurality of nozzle depictions;

wherein a rotation of the dial housing is configured to align one dial notch of the plurality of dial notches with the reference indicator;

wherein one dial notch of the plurality of dial notches is configured to position one light filter of the plurality of light filters centrally within the dial housing; and wherein the laser light is configured to pass through the light filter and issue through the lens.

4. The appliance specific laser aiming device of claim 1 wherein the plurality of nozzle depictions are beveled.

* * * * *